US006176159B1

(12) United States Patent
Risse

(10) Patent No.: US 6,176,159 B1
(45) Date of Patent: Jan. 23, 2001

(54) ERGONOMIC PLIERS

(75) Inventor: Georg Risse, Bogenstrasse 15/16, D-48143 Münster (DE)

(73) Assignee: Georg Risse, Munster (DE)

( * ) Notice: Under 35 U.S.C. 154(b), the term of this patent shall be extended for 0 days.

(21) Appl. No.: 09/351,024

(22) Filed: Jul. 12, 1999

(30) Foreign Application Priority Data

Jul. 10, 1998 (DE) ..... 198 30 998
Mar. 29, 1999 (DE) ..... 199 14 246

(51) Int. Cl.[7] ..... B25B 7/00
(52) U.S. Cl. ..... 81/427.5; 30/340
(58) Field of Search ..... 81/427, 427.5; 30/340

(56) References Cited

U.S. PATENT DOCUMENTS 442,155 * 12/1890 Virtue ..... 81/427.5
2,669,993 * 2/1954 Curutchet ..... 81/427.5
2,863,459 * 12/1958 Casper ..... 81/427.5
4,829,858 5/1989 Kern et al. .
4,934,222 * 6/1990 Rittmann ..... 81/427.5
4,961,742 * 10/1990 Torre ..... 606/147
5,253,557 10/1993 Dolak .
5,269,790 * 12/1993 Funatsu ..... 606/142
5,279,034 * 1/1994 Smith et al. ..... 30/232

FOREIGN PATENT DOCUMENTS 7102040 4/1971 (DE) .
35 45 411 6/1987 (DE) .
91 12 630 1/1992 (DE) .
41 17 899 11/1992 (DE) .
93 20 922 6/1995 (DE) .
0 228 032 7/1987 (EP) .
0 538 632 A1 * 4/1993 (EP) ..... B25G/1/10

* cited by examiner

*Primary Examiner*—James G. Smith
*Assistant Examiner*—David B. Thomas
(74) *Attorney, Agent, or Firm*—Knobbe, Martens, Olson & Bear, LLP

(57) ABSTRACT

The present invention relates to ergonomic pliers enabling improved handling, in particular in continuous application. For this purpose, the pliers comprise at least one thumb rest formed on a handle section on at least one leg of the pliers, which thumb rest essentially is dent-shaped.

16 Claims, 2 Drawing Sheets

ERGONOMIC PLIERS

FIELD OF THE INVENTION

Figure 1:
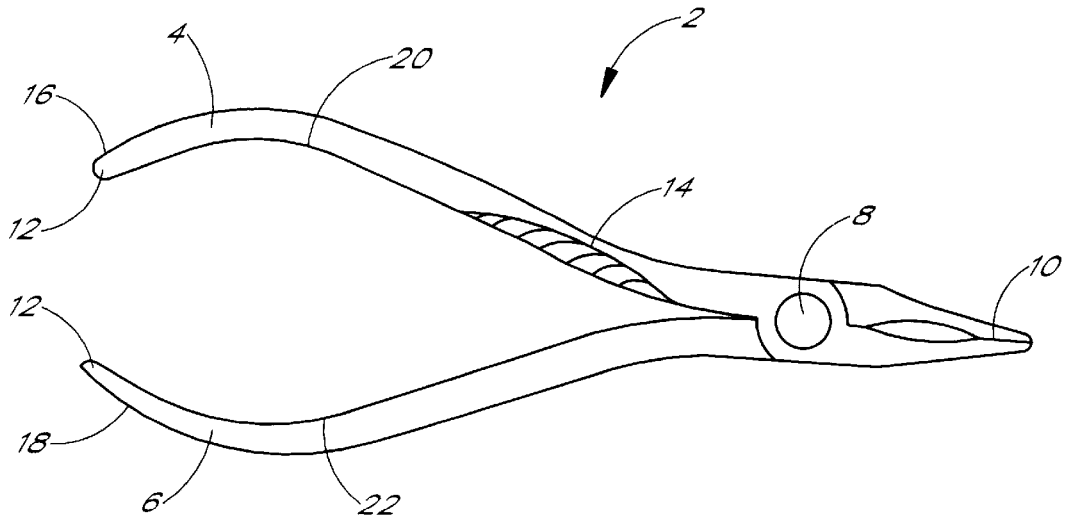

The invention relates to ergonomic pliers which in particular are applicable in the field of fine mechanics or medicine.

BACKGROUND OF THE INVENTION

Pliers typically comprise two legs rotatably connected to each other via a pivot and forming a working section and a handle section which are separated from each other in the area of the pivot. Each leg comprises an inner side, said inner side facing the inner side of the other leg, an outer side opposite said inner side, a front side and a rear side.

The application of fine mechanical or medical pliers typically requires a precisely controlled dosage and transmission of force, and the specific positioning of the working side at or in a working area. Said working area may be any material or a body portion of a patient, e.g. in the head or in an organ, having strictly limited space conditions. These activities may be required in normally accessible working areas or in hardly accessible apertures. During operation, the forces used may change from mere holding and positioning to the transmission of greater forces, such as e.g. for pinching operations.

The dynamic application of these pliers requires exact guiding capability. At the same time it should be possible that the position of the handle of the pliers can be easily changed in the hand during operation. Furthermore, it should be possible that the pliers can be easily and rapidly opened and closed in a precisely controllable manner.

During these activities, the pliers are usually opened by contacting the inner side of one leg of the handle with the small finger and/or also additionally with the ring finger, while they are closed with the remaining fingers contacting the outer side of the leg of the handle. In prior art pliers, there is no specific contacting or engagement area for the thumb during these opening and closing operations.

DE-A-35 45 411 and EP-A-0 228 032 disclose multipurpose pliers whose legs of the handle form one jaw each at their ends and are in working connection via a hinge. The legs of the handle of these pliers oppose each other in an ellipse-like manner in the plane of the legs of the handle. In the region of the coupling area with the hand, the legs of the handle have an ellipse-like cross-section. At each of the lateral flanks of the legs of the handle, there is a waisted recess provided in the region of the rest for the index finger and thumb. These recesses serve as bed for the thumb on the front side of the leg and as bed for the index finger on the rear side of the leg. These pliers in particular have the drawback that they do not sufficiently match the anatomy and anthropometry of the human hand, which is the reason why, in use, there are rapidly signs of tiredness and the pliers can no longer be positioned sufficiently precisely. On account of the ellipse-like design of the legs of the handle of the pliers, there is the further disadvantage that they can be applied in narrowly restricted working spaces to a limited extent only. The design of the thumb and index finger rest does not correspond to the optimum ergonomic aspects either and is therefore only insufficiently appropriate for continuous precise handling as is necessary for the purpose of fine mechanical and medical tasks.

DE-U-93 20 922 discloses an ergonomic handle structure for tools. The two legs of the handle of these pliers have an arch-like shape, wherein the radius of the arch and the curvature may vary. For achieving an ergonomic handle design, it is suggested that the arched handle parts are extended by the use of extension pieces which are made of a flexible plastics material. These pliers are disadvantageous in that the flexible extensions of the legs of their handle do not permit precise handling when holding the pliers at their rear ends. Further drawbacks consist in that, while the flexible leg ends can match the hand of a user, it always requires force or pressure to adjust the shape of the handle. This entails tender spots and undesired tenseness in the user, which considerably restricts the handleability of the pliers, in particular in the field of fine mechanics or medicine. With the design of the pliers with extensions at the legs of the handle, said pliers are useful for the application in narrowly restricted spaces to a limited extent only.

DE-U-71 02 040 relates to a knife haft comprising grooves having various lengths and intended to permit firm gripping of the knife haft. The sides of the knife haft may be provided with a very rough surface. The knife haft is preferably provided with an oval recess at its upper side for receiving the thumb.

DE-U-91 12 630 relates to a handle for tools which consists of an elongate handle sleeve which is made of plastics. The handle sleeve is to be placed on a leg of pliers and comprises an inner surface and an outer gripping surface. The handle sleeve is formed of a compression-elastically deformable soft plastics material at least in the region of the gripping area.

DE-C-41 17 899 relates to pliers comprising a hinge, a tool end and a handle end, wherein each end comprises two legs and each leg exhibits one inner surface, one outer surface and two lateral surfaces. When a finger presses against the inner surface of a handle leg during opening the pliers with one hand, a supporting section at said inner surface prevents the finger from slipping.

All of these known pliers have the disadvantage of poor handleability, in particular because ergonomic aspects as well as the motions actually taking place when handling pliers have insufficiently been taken into consideration.

SUMMARY OF THE INVENTION

It is an object of the present invention to provide improved pliers which in particular are applicable in the field of fine mechanics and/or medicine.

The invention is based on the finding that such pliers should be designed such that the thumb can play a decisive role in the exact control of opening and closing the pliers.

This means that the thumb should be in a position to exert counter-pressure when opening the pliers and to provide guidance when closing the pliers. In the pliers of the invention, the thumb can easily be placed between the two legs of the pliers during closing them and thus can precisely control the dosage and transmission of force during the closing operation.

The invention is based on the concept of providing pliers having on at least one of their legs an area which is designed as a thumb rest and preferably formed at the edge between the inner side and the front and/or rear side of the pliers. Preferably, the thumb rest is provided towards the space between the legs. Furthermore, the thumb rest is preferably provided at an end area of the handle section facing the working section or adjacent the working section.

Since the pliers according to the invention are intended to be applicable for different purposes, the working side of the pliers may have any design and structure.

A principal distinction can be made in the art between pliers for rough, mechanical applications, in which above all force is to be transmitted, and those for mainly creative and fine-mechanical applications. These two types of pliers usually have a different design and structure and are held differently in the hand or rather are differently guided by the hand. For pliers in the rough field of application, mainly hinge motions are required for transmitting force. As described, for instance, in EP-A-0 228 032, the thumb assumes clamping and contraction tasks. The directions in which the pliers can be used are considerably restricted and are mainly controlled by the wrist. As regards fine mechanical pliers, the particular anatomic position and length of the thumb as well as its specific anatomic ball bearing play an important role. The thumb and the remaining fingers as well as the thumb and the inner hand are arranged opposite to each other and cooperate in this position during motions as regards the size and direction of forces applied. The rough direction is additionally predetermined by the wrist.

Despite the aforementioned differences between pliers for rough applications and those for fine mechanical applications, the principle of the invention can be applied for all types of pliers.

For the specific application of static and dynamic forces the aforementioned thumb rest area according to the invention is of considerable importance. In conventional pliers, said area often has sharp edges, which impairs the comfort of the thumb, entailing its irritation in permanent application, and which also impairs the precision of the application. Furthermore, conventional pliers are often designed in a way ergonomically unfavourable for the index finger and the remaining fingers as well as for the ball of the thumb. According to the invention, the thumb rest extends, for example, essentially in the form of a dent in the area adjacent an edge formed between the inner side and the front and/or rear side of at least one of the legs, thus smoothening or eliminating said edge in the area of the thumb rest. The specific shape and dimension of the thumb rest may depend on the purpose of application of the pliers.

In another embodiment, the essentially dent-shaped thumb rest extends across both legs of the handle of the pliers, wherein the dent is preferably formed by two partial dents or dent halves, which are placed on the two legs of the handle and together form a dent-shaped depression adapted to the anatomy of the human thumb when the pliers are in a closed position. Generally, however, bevelled edges in this area of, for instance, at least 0.5 mm depth of the bevel are extremely advantageous and permit a handleability which is considerably improved in comparison to known pliers.

Preferably, said area or the dent is provided with a non-slip surface or formed of a non-slip material. For even better adapting the pliers to the anatomy of the hand of a user, it is preferred according to the invention that the ends of the handle portion facing away from the working section are bent inwards to a relatively considerable extent so that the pliers altogether form a drop-like or streamlined space-saving arrangement for being able to optimally work in narrow spaces. The working section of the pliers can be designed for any applications and operations.

The pliers according to the invention have the advantage that they very well meet the demands on the hand of a user, both as regards anatomic aspects, so that in particular irritations are avoided, and as regards its handleability. In the embodiment with the thumb rest on only one of the legs of the handle on the front and/or rear side of the pliers, a considerably better handleability is ensured than in conventional pliers, since said thumb rest is located at the essential engagement position for the thumb, and the remaining fingers of the user's hand are provided as counter-elements on the opposite side. Furthermore, said thumb rest can be specifically adapted depending on the object to be treated or the respective operation. Further advantages reside in the precise control of the applied force and its dosage by means of the thumb rest, in the rapid and precisely controlled manner of opening and closing the pliers as well as in the faster and more precise change of the position of the pliers in the hand. On account of their shape, the pliers are in particular considerably more comfortable for the thumb, index finger and ball of the thumb so that a generally better dosage for application and a better handleability of the pliers are guaranteed.

A further advantageous aspect of the present invention consists in that already existing pliers can be subsequently provided with an ergonomic handle by fitting sleeve constructions according to the invention over the handle.

BRIEF DESCRIPTION OF THE INVENTION

Figure 2:
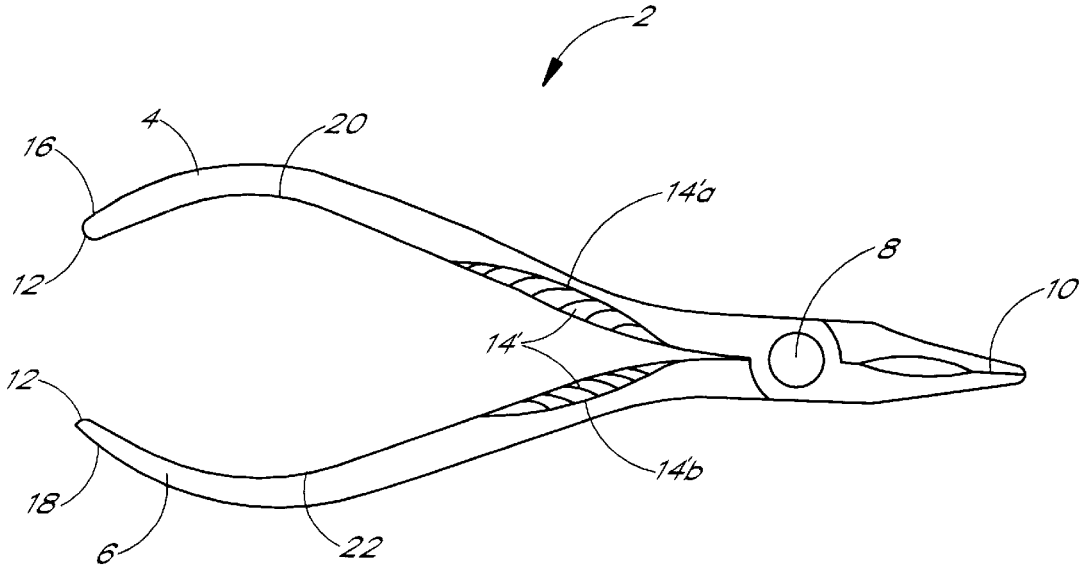
Figure 4:
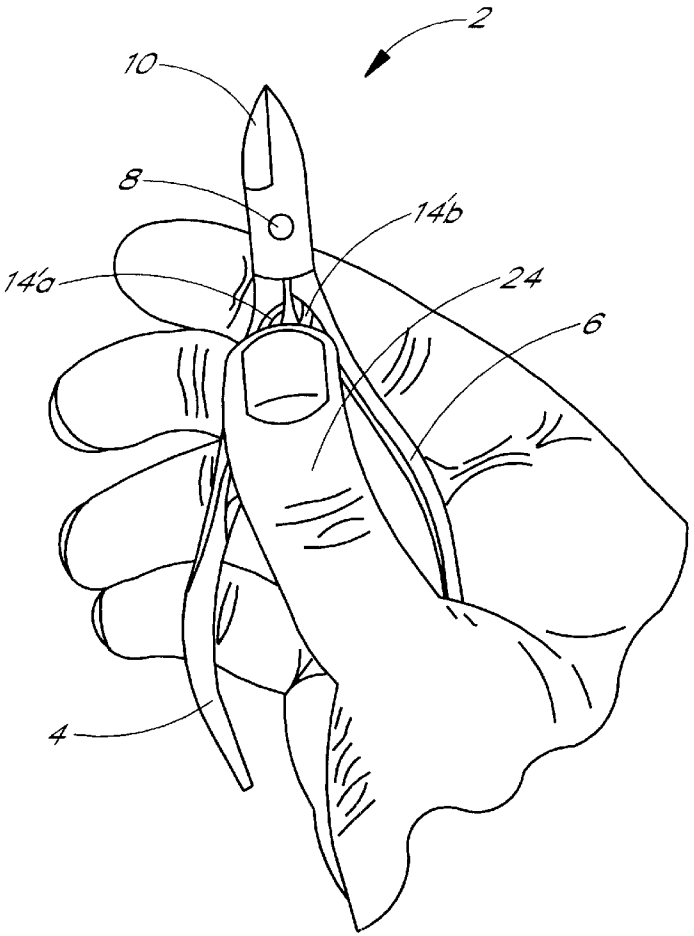
Figure 3:
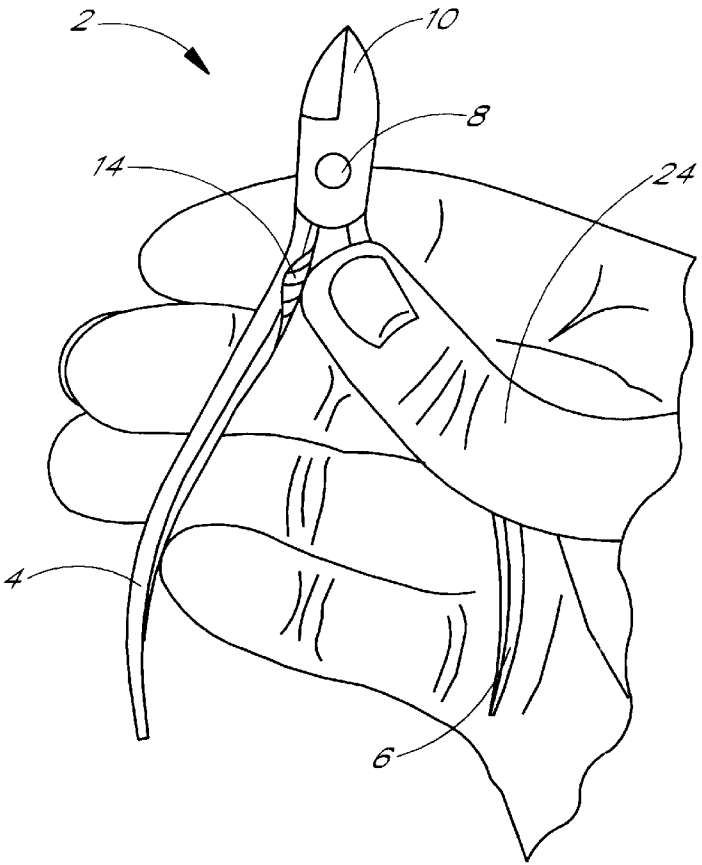

The invention is exemplarily illustrated in the following by means of two embodiments with reference to the attached drawing. In the drawing FIG. 1 shows a front view of the first embodiment of the ergonomic pliers according to the invention;

FIG. 2 shows a front view of the second embodiment of the ergonomic pliers according to the invention;

FIG. 3 a schematic representation of the way in which the handle of the pliers according to the first embodiment of the invention is held; and FIG. 4 a schematic representation of the way in which the handle of the pliers according to the second embodiment of the invention is held.

The pliers 2 shown in FIGS. 1 and 2 are preferably pliers which are applicable in the field of fine mechanics, medicine or orthodontics but they can also be designed for any other application.

The pliers 2 essentially consist of two legs 4 and 6, which are crosswise connected to each other via a rotational axis 8. The pliers 2 are provided with a working section 10 at the one side of the rotational axis 8 and a handle section 12 at the other side of the rotational axis 8. Apart from the crosswise design of the pliers 2, in which the working section 10 is compressed when the handle section 12 is compressed, the pliers according to the invention can also exhibit a parallel arrangement, in which the pliers open when the handle section 12 is compressed.

The first embodiment of the pliers 2 according to the invention as represented in FIG. 1 comprises a thumb rest 14 which is provided at the leg 4 of the pliers for controlling the opening and closing operations of the pliers 2. The thumb rest 14 is essentially formed in the direction of the opposite leg 6 of the pliers or rather in the area of an edge of the inner side of the leg 4 facing the leg 6. The thumb rest is provided in a bevelled, recessed, broken and/or dent-shaped way. A bevel in the edge of e.g. at least 0.5 mm , preferably at least 1 mm depth already produces a defined thumb rest 14, which enhances the handleability of the pliers 2.

DETAILED DESCRIPTION OF THE INVENTION

According to a second embodiment of the pliers according to the invention as shown in FIG. 2, a thumb rest 14' consisting of two thumb rest portions or thumb rest halves

14'*a* and 14'*b* is formed on the handle section 12 irrespective of the type of the pliers 2. The thumb rest 14 or 14' may be provided on only one side, i.e. front or rear side, of the pliers 2 as well as on both sides. The halves 14'*a* and 14'*b* of the thumb rest 14' form together a dent-shaped area into which the thumb of a user is placed. As regards their areas and/or shapes, the two halves 14'*a* and 14'*b* of the thumb rest may be designed identically, i.e. symmetrically, or differently, i.e. asymmetrically. In particular, it may be advantageous to design the thumb rest surface which is farther away from the user's ball of the thumb such that it is deeper, or rather more distinct, i.e. for instance bevelled or recessed to a greater extent.

In the closed position of the pliers, the thumb rest 14 or 14' has preferably the shape of a ball or sphere portion or of a rotational oval portion adapted to the anatomy of the human thumb. This sphere or rotational oval portion can be open or cut off in the direction away from the rotational axis 8 so that the user's thumb is automatically favourably placed in the thumb rest 14 or 14'. However, any other anatomically favourable shape is also possible for the thumb rest 14 or 14'. The edges of the thumb rest 14 or 14' may additionally be smoothed off.

It is also possible to provide different or identical thumb rests 14 and 14' at the front and rear sides of the pliers 2.

By means of this dent-shaped area, the specific application of static and dynamic forces for the use of the pliers can be performed without an irritation of the thumb occurring, wherein at the same time the handling possibilities and handleability of the pliers and thereby individual performance can be enhanced.

The dent-shaped design of the thumb rest 14 or 14' is intended to correspond to the form, i.e. the anatomy and anthropometry, of the thumb for meeting the requirements of precision work and guidance in the case of different materials also in hardly accessible areas in which it is difficult for the user to manipulate the pliers and to have visual access to the working site. Specifically in hardly accessible areas, the tip of the pliers of the invention is pushed far to the front, wherein the thumb is farthest at the front and the hand may be at the end of the legs of the handle so that in this way an arrangement as streamlined and space-saving as possible is achieved. On the other hand, in the normal operation, the position of pliers relative to the hand is rather rectangular. With the pliers of the invention, a repositioning of the pliers in the hand of up to 180° during a work cycle is smoothly and gradually possible without losing control and guidance of the pliers. In this connection, the thumb is always the central location of rotation and orientation.

The term "dent-shaped" as used within the meaning of the invention covers the provision of hollows, flattenings, bevels, recesses and/or extensions, bulges or bloatings of any kind which enable the ergonomic handling of the pliers and can enlarge the rest area of the thumb.

For further increasing the ergonomic adaptability of the pliers 2 to the hand of the user, the ends 16 or 18 of the handle section 12 of the legs 4 and 6 may be bent inwards to a considerable extent for providing a larger rest area at the ends 16 and 18 of the handle section 12 for the user. It is thereby possible to achieve an even better handleability of the pliers 2.

The inner edges 20 and 22 of the legs 4 and 6, respectively, of the handle section 12 are preferably considerably smoothed off so that the pliers 2 lie more comfortable in the hand of a user.

The handle section 12 of both legs 4 and 6 in the shape according to the invention can either be directly formed together with the pliers or can be subsequently applied or designed in a combined way. In the case of subsequently applied handle elements, they are preferably made as hollow elements and pushed or fitted over the legs 4 and 6 of the handle section 12. Thus, it is also possible to provide conventional pliers subsequently with the handle section designed according to the invention.

FIGS. 3 and 4 show how the pliers are held in a user's hand. FIGS. 3 and 4 show fine mechanical pliers with the possibility of positioning the thumb on the thumb rest 14 or 14', for instance for a horizontal or vertical application.

The way of holding the pliers 2 as represented in FIG. 3 shows the thumb 24 of a user of the pliers 2 according to the invention in which the thumb rest 14 is mainly or exclusively formed at the handle leg 4. FIG. 4 shows the way of holding the pliers 2 with the thumb 24 on a common dent-shaped thumb rest 14 which extends across both legs 4 and 6 of the handle.

What is claimed is:

1. Pliers comprising two legs rotatably connected to each other via a pivot and forming a working section and a handle section having two opposing legs, each leg having an inner surface facing the opposing leg, an outer surface opposite the inner surface, and front and rear surfaces extending between the inner and outer surfaces respectively, wherein on at least one of said opposing legs the edge formed between said inner surface and said front surface is interrupted along its length by a depression positioned to form a thumb rest.

2. The pliers according to claim 1, wherein the thumb rest is provided at an end area of the handle section adjacent to the working section.

3. The pliers according to claim 1, wherein the thumb rest is composed of a first thumb rest portion formed on one of said opposing legs and a second thumb rest portion formed on the other of said opposing legs and extends across both legs.

4. The pliers according to claim 3, wherein said first and second thumb rest portions together have substantially the shape of a dent.

5. The pliers according to claim 3, wherein the two thumb rest portions forming the thumb rest substantially have the form of one of a sphere portion and a rotational oval portion when the pliers are in a closed position.

6. The pliers according to claim 3, wherein the two thumb rest portions are differently designed on the two legs.

7. The pliers according to claim 1, further comprising an additional thumb rest, said additional thumb rest formed between said inner surface and said rear surface.

8. The pliers according to claim 1, wherein a first rounded edge adjoins said depression and said inner surface and a second rounded edge adjoins said depression and said front surface.

9. The pliers according to claim 1, wherein at least one of the thumb rest and the handle section are at least partially made of a non-skid material.

10. The pliers according to claim 1, wherein the handle section is at least partially made of plastics.

11. The pliers according to claim 1, wherein the handle section on at least one of the two legs comprises a hollow element which can be applied onto said leg of the pliers.

12. The pliers according to claim 11, wherein the hollow element is made of a flexible material.

13. The pliers according to claim 11, wherein the hollow element is made of a plastics material.

14. The pliers according to claim 1, wherein the two legs are bent inwards at ends facing away from the working section to form a drop-like configuration of the pliers.

15. Pliers comprising two legs rotatably connected to each other via a pivot and forming a working section and a handle section having two opposing legs, each having an opposing interior surface, wherein a depression providing a thumb rest is situated on said interior surface of at least one of said opposing legs at a location proximate to said pivot.

16. The pliers according to claim 15, wherein the thumb rest is composed of a first thumb rest portion formed on one of said opposing legs and a second thumb rest portion formed on the other of said opposing legs and extends across both legs.

* * * * *